US009268283B1

(12) United States Patent
Sugiyama

(10) Patent No.: US 9,268,283 B1
(45) Date of Patent: Feb. 23, 2016

(54) TONER SUPPLY DEVICE

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Tadashi Sugiyama, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/661,129

(22) Filed: Mar. 18, 2015

(51) Int. Cl.
*G03G 15/08* (2006.01)
*G03G 15/00* (2006.01)

(52) U.S. Cl.
CPC ..... *G03G 15/553* (2013.01); *G03G 2215/0888* (2013.01)

(58) Field of Classification Search
CPC ..... G03G 15/553; G03G 2215/0888; G03G 15/0831
USPC ..... 399/27
See application file for complete search history.

(56) References Cited

FOREIGN PATENT DOCUMENTS

JP 2005227559 A * 8/2005
JP 2010134095 A * 6/2010

OTHER PUBLICATIONS

Machine translation of JP 2010134095.*

* cited by examiner

*Primary Examiner* — David Bolduc
*Assistant Examiner* — Barnabas Fekete
(74) *Attorney, Agent, or Firm* — Amin, Turocy & Watson, LLP

(57) ABSTRACT

According to one embodiment, a toner supply device includes a motor and an estimating unit. The motor rotates a toner container that supplies a toner to an image forming apparatus. The estimating unit estimates a toner residual amount in the toner container at a second point in time on the basis of a total rotation time representing time in which the motor rotates in a period of use from a first point in time when the toner container is attached to the image forming apparatus to the second point in time.

9 Claims, 8 Drawing Sheets

TONER SUPPLY DEVICE

FIELD

Embodiments described herein relate generally to a toner supply device.

BACKGROUND

In recent years, an image forming apparatus such as an MFP (Multi Function Peripheral) forms an image on a sheet-like medium (hereinafter referred to as "sheet") such as paper using a coloring agent such as a toner. In the image forming apparatus, a dedicated container in which the toner is stored (hereinafter referred to as "toner container") is attached in a predetermined position. The image forming apparatus receives the supply of the toner from the toner container by rotating a motor provided to drive a supply mechanism of the toner container. The image forming apparatus calculates an amount of the toner present in the toner container (hereinafter referred to as "toner residual amount"). The image forming apparatus displays the calculated toner residual amount.

In the related art, the toner residual amount is estimated on the basis of an integrated value of a rotation time of the motor and a predetermined reference time.

However, if fluctuation occurs in the number of revolutions of the motor or if the number of revolutions of the motor is not fixed, the toner residual amount sometimes cannot be accurately estimated.

DETAILED DESCRIPTION

In general, according to one embodiment, a toner supply device includes a motor and an estimating unit. The motor rotates a toner container that supplies a toner to an image forming apparatus. The estimating unit estimates a toner residual amount in the toner container at a second point in time on the basis of a total rotation time representing time in which the motor rotates in a period of use from a first point in time when the toner container is attached to the image forming apparatus to the second point in time.

A toner supply device according to a first embodiment is explained with reference to the drawings.

Figure 1:
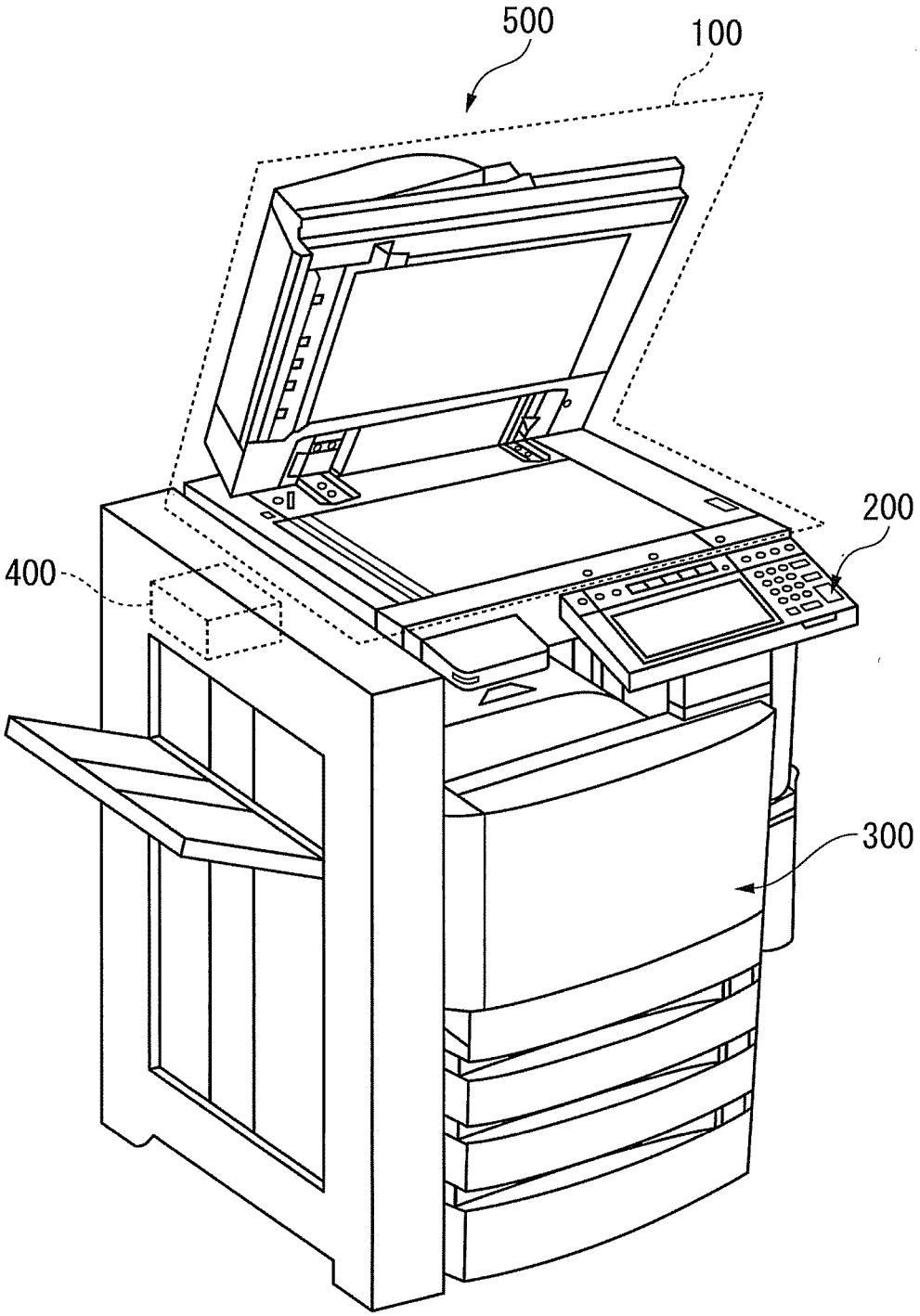
FIG. 1 is an external view showing an example of the configuration of an image forming apparatus including a toner supply device according to a first embodiment.

FIG. 1 is an external view showing an example of the configuration of an image forming apparatus 500 including a toner supply device 10 according to the first embodiment.

The image forming apparatus 500 is a multifunction peripheral (MFP) capable of forming a toner image on a sheet. The image forming apparatus 500 includes, for example, a printer function, a copy function, a reading function, and a facsimile function. The sheet is, for example, an original document or paper on which characters and pictures are drawn. The sheet may be any object as long as the image forming apparatus 500 can form an image on the object. The image forming apparatus 500 includes an image reading unit 100, a control panel 200, an image forming unit 300, a control device 400, and the toner supply device 10.

The image reading unit 100 reads, with a scanning optical system, an image from a sheet placed in a predetermined position. The scanning optical system includes, for example, an image pickup device such as a CCD (Charge Coupled Device) or a CIS (Contact Image Sensor). The image reading unit 100 generates image data from the read image and transmits the generated image data to the image forming unit 300.

The control panel 200 functions as a user interface that receives an operation input from a user. The control panel 200 includes, for example, a touch panel in which an operation unit and a display unit are integrally formed. The control panel 200 is communicably connected to the control device 400. The operation unit of the control panel 200 receives an instruction for the operation of the image forming apparatus 500 on the basis of the operation by the user. The display unit of the control panel 200 displays information to the user. The display unit of the control panel 200 displays, for example, information indicating that a toner container is nearly empty. In the following explanation, the information indicating that the toner container is nearly empty is referred to as "near-empty information". Note that the control panel 200 is an example of an "input receiving unit".

The image forming unit 300 forms an image on a sheet using a coloring agent such as a toner. The image forming unit 300 forms an image on the basis of the image data read by the image reading unit 100 or image data received from an external device. The image data is represented by, for example, color information of red (R), green (G), blue (B), and the like.

The image forming unit 300 converts the input image data into image data of yellow (Y), magenta (M), cyan (C), and black (K) through image processing. In the following explanation, the converted image data is described as "image data after conversion". The image forming unit 300 forms, with light of a laser, an LED, or the like, an electrostatic latent image based on the image data after conversion on a photoconductive surface of a photoconductive body. The LED is the abbreviation of "Light Emitting Diode".

The image forming unit 300 supplies the toner to the electrostatic latent image formed on the photoconductive surface of the photoconductive body and visualizes the electrostatic latent image as a toner image. The image forming unit 300 transfers the toner image visualized on the photoconductive surface onto the sheet. The image forming unit 300 heats and pressurizes the sheet onto which the toner image is transferred. Consequently, the image forming unit 300 can form an image corresponding to the image data on the sheet.

If an amount of the toner supplied to the photoconductive body is smaller than a reference amount, the image forming unit 300 transmits an instruction signal to the control device 400. The amount of the toner is detected by a not-shown detecting unit. The instruction signal is a signal for instructing the control device 400 to perform processing for supplying the toner from the toner container to the image forming unit 300.

The toner container attached to the image forming apparatus 500 includes a supply mechanism. The supply mechanism supplies an agitated toner from the toner container to the photoconductive body on which the electrostatic latent image is formed. The toner container is, for example, a hollow rectangular parallelepiped container. A spiral member is included in the toner container. The spiral member is provided in the toner container along the longitudinal direction of the toner container. The spiral member rotates around a center axis extending in the longitudinal direction of the spiral member and agitates the toner. The toner is pushed out from the toner container toward a supply destination according to the rotation of the spiral member. The toner pushed out from the toner container adheres to the photoconductive body with an electrostatic force. Consequently, the electrostatic latent image formed on the photoconductive surface of the photoconductive body is visualized as a toner image.

The control device 400 is a computer that controls the image forming apparatus 500. The control device 400 includes a processor such as a CPU (Central Processing Unit). The control device 400 includes a communication interface for performing communication with an external device. The external device is a device other than the control device 400. The control device 400 controls, for example, the image reading unit 100, the control panel 200, the image forming unit 300, and the toner supply device 10.

Figure 2:
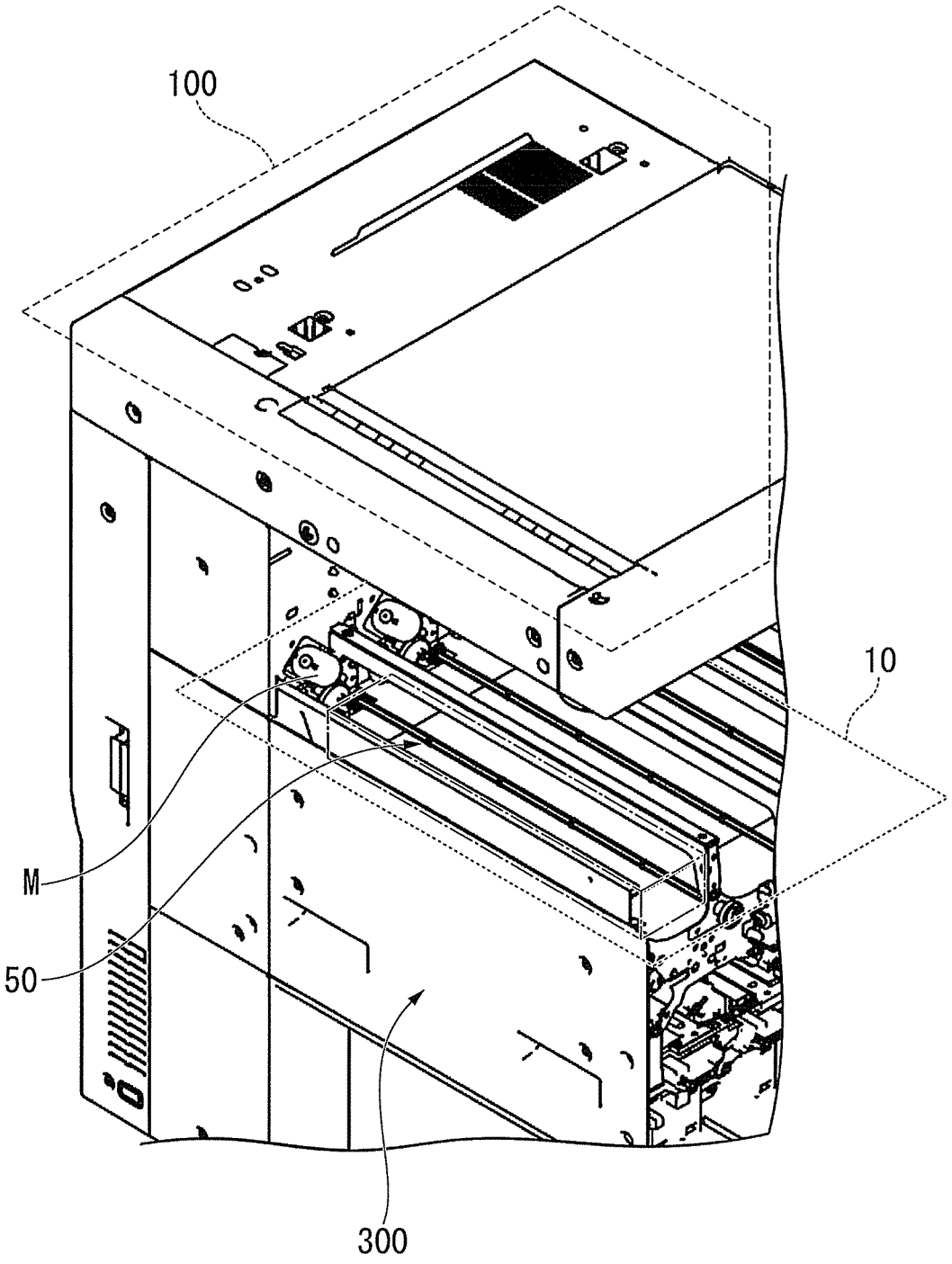
FIG. 2 is a diagram of an example of setting positions of a toner container and the toner supply device in the image forming apparatus.
Figure 3:
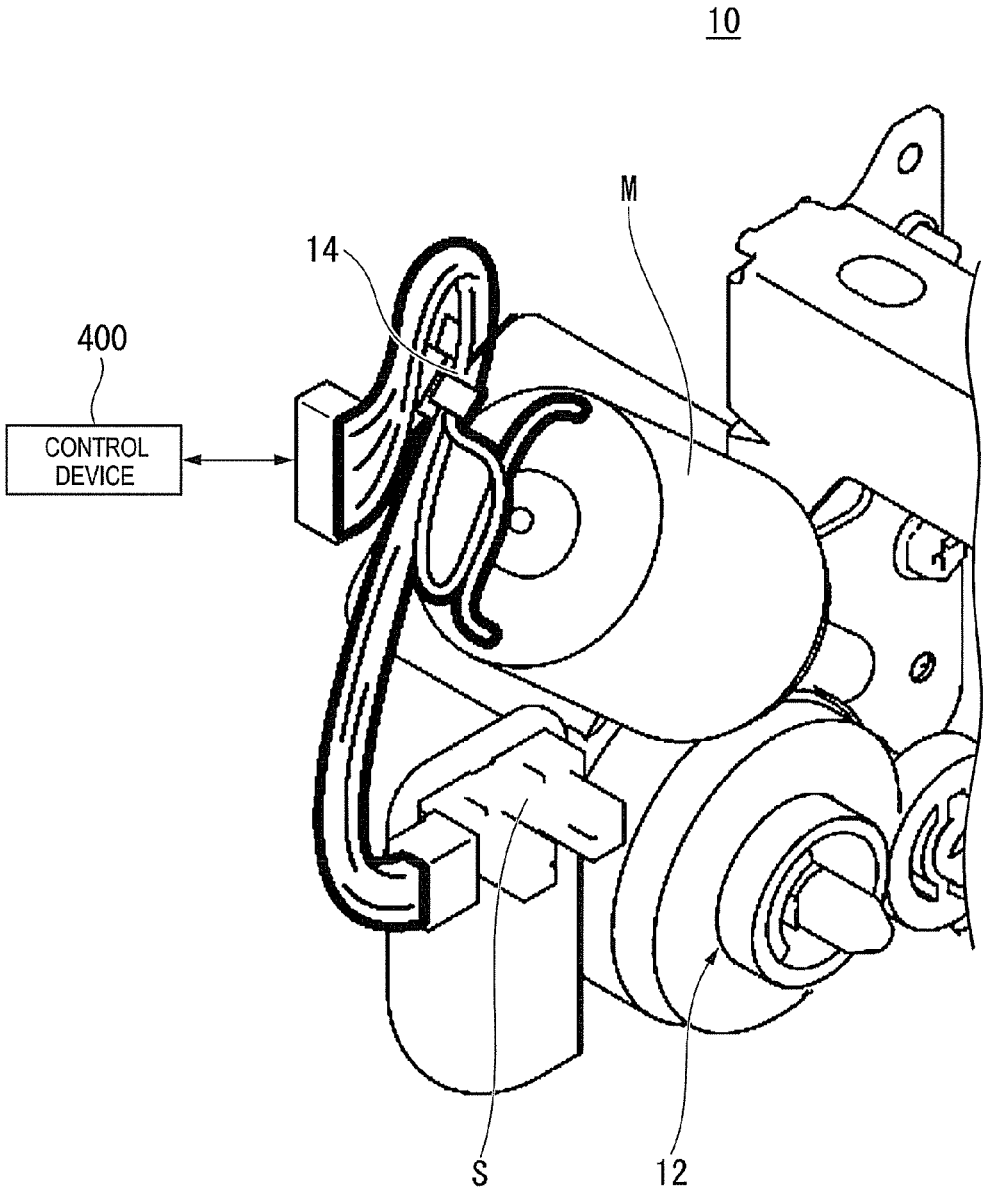
FIG. 3 is an enlarged view showing an example of the toner supply device.

The configuration of the toner supply device 10 according to the first embodiment is explained with reference to FIGS. 2 and 3. FIG. 2 is a diagram of an example of setting positions of the toner container and the toner supply device 10 in the image forming apparatus 500. FIG. 3 is an enlarged view showing an example of the toner supply device 10. The toner supply device 10 includes a motor M and a sensor S. The toner supply device 10 supplies the toner from the toner container attached in the image forming apparatus 500 to the photoconductive body of the image forming unit 300.

The motor M is, for example, a commutator motor such as a DC brush motor. The number of revolutions of the motor M cannot be controlled at the same frequency and the same voltage. The motor M is connected to, via a coupling gear 12, the supply mechanism of the toner container attached in a space 50.

The motor M rotates the coupling gear 12 to drive the supply mechanism. Consequently, the toner in the toner container is supplied to the image forming unit 300. The motor M is set in advance during manufacturing to be driven at a fixed number of revolutions per unit time (hereinafter described as "rated number of revolutions Rs"). The rated number of revolutions Rs is an example of "the number of revolutions in design" in the motor M. A unit of the number of revolutions is, for example, rpm (revolution per minute).

The sensor S is an optical sensor that detects presence or absence, a position, and speed of an object. The sensor S is an example of a "detecting unit". The sensor S includes, for example, a light emitting unit that emits light and a light receiving unit that receives light reflected from a target object. The sensor S is connected to a control cable 14 that connects the motor M and the control device 400. For example, the sensor S irradiates the light emitted by the light emitting unit on the supply mechanism provided with slits. The slits are provided at an equal interval in the circumferential direction in a rotating member of the supply mechanism. When the rotating member of the supply mechanism is rotated by the motor M, the light irradiated from the sensor S is intermittently reflected from the rotating member of the supply mechanism according to the interval at which the slits are provided. In the following explanation, the interval at which the slits are provided is described as "angle interval". The light reflected by the rotating member of the supply mechanism is received by the light receiving unit. Consequently, the sensor S converts mechanical rotation displacement of the rotating supply mechanism into an electric pulse signal. The sensor S transmits the electric pulse signal to the control device 400 via the control cable 14. Consequently, the control device 400 can calculate the number of revolutions of the supply mechanism from the pulse width of the pulse signal and the angle interval of the slits. The control device 400 can calculate the number of revolutions Rm of the motor M from a ratio of the number of revolutions of the rotating member of the supply mechanism and the number of revolutions of the motor M. The number of revolutions Rm is a fixed number of revolutions per unit time.

Figure 4:
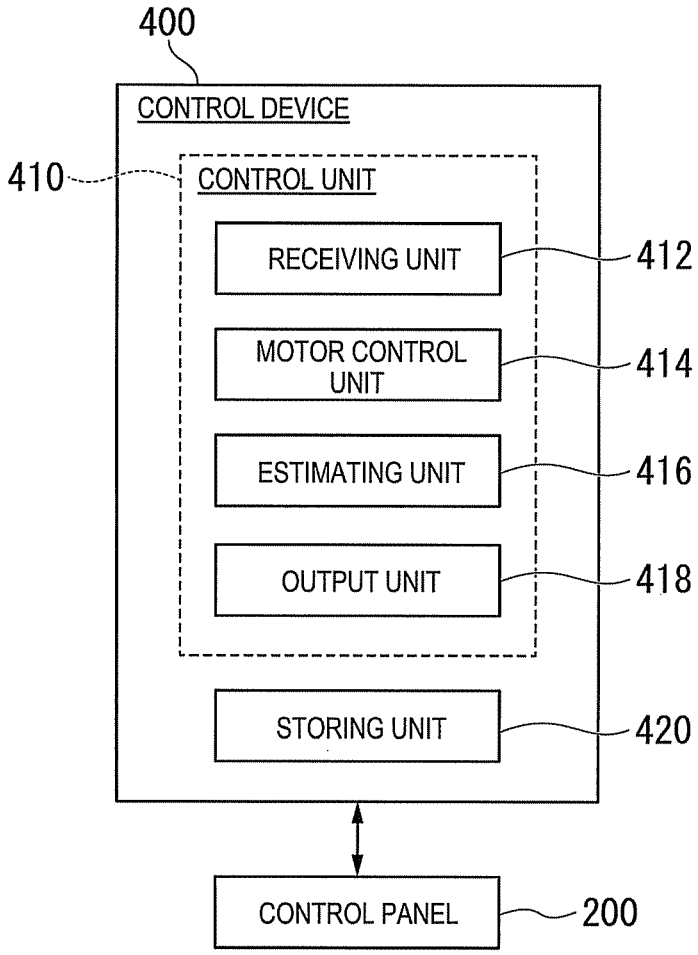
FIG. 4 is a diagram of an example of a functional configuration of a control device according to the first embodiment.

FIG. 4 is a diagram showing an example of a functional configuration of the control device 400 according to the first embodiment.

The control device 400 includes a control unit 410 and a storing unit 420. The control unit 410 includes a receiving unit 412, a motor control unit 414, an estimating unit 416, and an output unit 418. The control unit 410 is, for example, a software functional unit that functions when a processor executes a program stored in a storage device. A part or all of functional units of the control unit 410 may be hardware functional units such as an LSI and an ASIC. The LSI is the abbreviation of "Large Scale Integration". The ASIC is the abbreviation of "Application Specific Integrated Circuit".

The storing unit 420 is a storage device such as a ROM, a HDD, an EEPROM, or a flash memory. The ROM is the abbreviation of "Read Only Memory". The HDD is the abbreviation of "Hard Disk Drive". The EEPROM is the abbreviation of "Electrically Erasable Programmable Read-Only Memory". The storing unit 420 is controlled to store, for example, information such as the number of revolutions Rm, the rated number of revolutions Rs, the number of revolutions Ri, a rotation time Pm, a rotation time Ps, a rotation time Pi, a toner residual amount, a specified value, an allowance, and time. The toner residual amount is an amount of the toner present in the toner container. The specified value is a threshold used in outputting the toner residual amount. The allowance is a threshold in a difference between the rated number of revolutions Rs and the number of revolutions Rm. The time is time when the control device 400 receives an instruction signal.

The receiving unit 412 receives an instruction signal transmitted from the image forming unit 300.

The motor control unit 414 controls, at time T1 when the receiving unit 412 receives the instruction signal, a not-shown constant current source to apply a driving current to the motor M. The driving current is an electric current necessary for rotating the motor M at the rated number of revolutions Rs. The constant current source is a device that supplies the driving current to the motor M.

The motor control unit 414 performs control to correct the predetermined rotation time Ps of the motor M on the basis of the number of revolutions Rm.

For example, the motor control unit 414 corrects the rotation time Ps to equalize a reference toner amount Vs and an estimated toner amount Vm. The reference toner amount Vs is an amount of the toner supplied when the supply mechanism is driven at the rated number of revolutions Rs of the motor M for a fixed period. The reference toner amount Vs is an example indicating "a predetermined amount of the toner".

The estimated toner amount Vm is an amount of the toner predicted to be supplied when it is assumed that the supply mechanism is driven at the number of revolutions Rm of the motor M.

More specifically, as the correction, the motor control unit 414 multiplies the rotation time Ps with a value (Rs/Rm) obtained by dividing the rated number of revolutions Rs by the number of revolutions Rm. In the following explanation, the rotation time Ps multiplied with the value (Rs/Rm) is described as "rotation time Pm".

The reference toner amount Vs is calculated on the basis of a function indicating a relation between an amount of the toner to be supplied and the number of revolutions and a rotation time. For example, if the number of revolutions is fixed, the function is represented as a function indicating a relation in which the amount of the toner to be supplied is linear with respect to the rotation time. The function is calculated by a simulation, an experiment, or the like in advance. In calculating the function, it is suitable to exclude a period in which the number of revolutions is not fixed (e.g., a transition period).

The estimating unit 416 calculates, as a total rotation time, the rotation time Pm integrated in a period of use. The period of use is a period from time T2 when the motor control unit 414 starts application of an electric current to the motor M to time T3 when the unit 414 stops application.

The estimating unit 416 estimates a toner residual amount in the toner container at the time T3 on the basis of the calculated total rotation time. For example, the estimating unit 416 estimates, on the basis of a function indicating a correspondence relation between the total rotation time and the toner residual amount, a toner residual amount corresponding to the calculated total rotation time.

If the toner residual amount estimated by the estimating unit 416 is a specified value or less, the output unit 418 outputs the near-empty information to the display unit of the control panel 200. For example, the specified value is a value indicating 10% or less of an amount of the toner in the toner container at the time when the toner container is attached.

Figure 5:
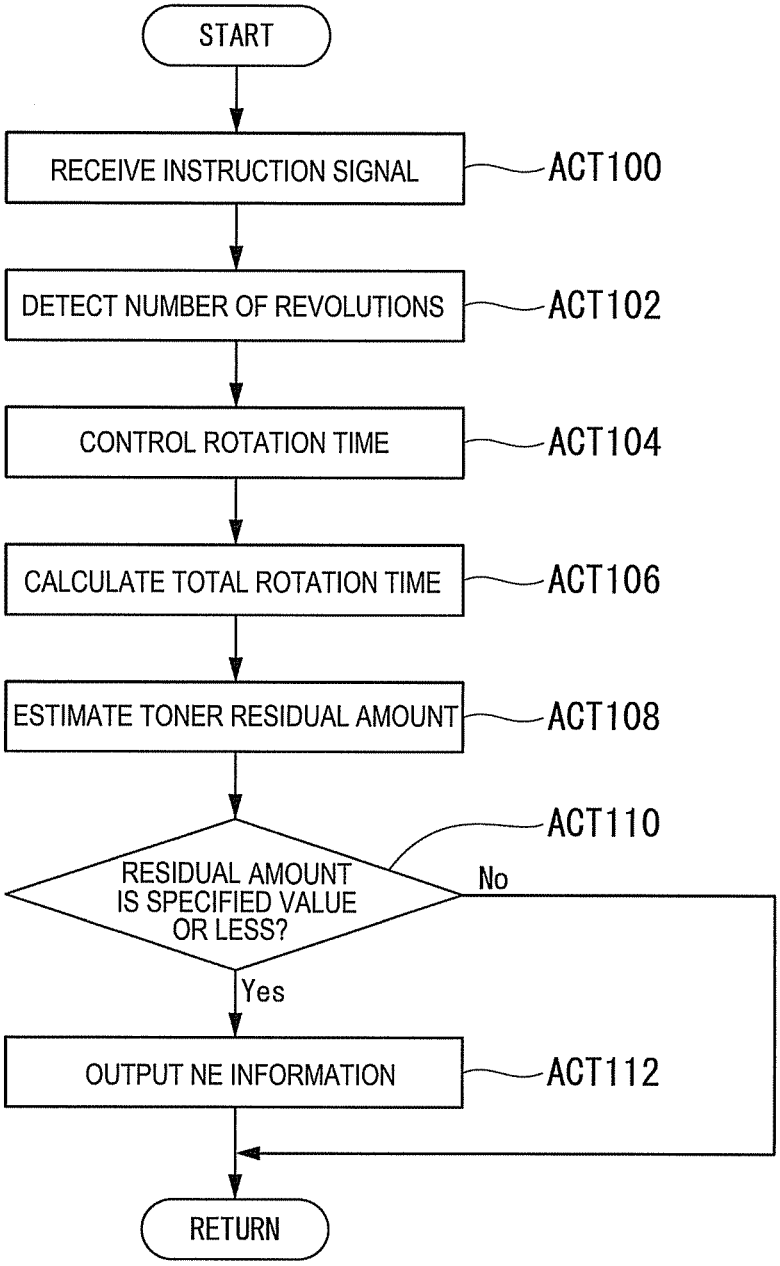
FIG. 5 is a flowchart for explaining an example of a flow of the operation of the toner supply device according to the first embodiment.

FIG. 5 is a flowchart for explaining an example of a flow of the operation of the toner supply device 10 according to the first embodiment.

First, the receiving unit 412 receives an instruction signal transmitted from the image forming unit 300 (ACT 100). Subsequently, the control device 400 acquires the number of revolutions Rm of the motor M (ACT 102). Subsequently, the motor control unit 414 controls, at the time T1 when the receiving unit 412 receives the instruction signal, the constant current source to apply a driving current necessary for rotating the motor M at the rated number of revolutions Rs to the motor M. The motor control unit 414 performs control to correct the predetermined rotation time Ps of the motor M on the basis of the number of revolutions Rm (ACT 104).

Subsequently, the estimating unit 416 calculates, as a total rotation time, the rotation time Pm integrated in the period of use (ACT 106). The estimating unit 416 estimates a toner residual amount in the toner container at the time T3 on the basis of the calculated total rotation time (ACT 108).

Subsequently, the output unit 418 determines whether the toner residual amount estimated by the estimating unit 416 is the specified value or less (ACT 110). If the toner residual amount is the specified value or less (Yes in ACT 110), the output unit 418 outputs the near-empty information to the display unit of the control panel 200 (ACT 112). If the toner residual amount exceeds the specified value (No in ACT 110), the output unit 418 does not output the near-empty information. In the figures referred to below, the near-empty information is represented as "NE information". The processing of this flowchart ends.

In the toner supply device according to the first embodiment explained above, the supply mechanism for supplying the toner in the toner container to the external device is driven. The toner supply device estimates a toner residual amount in the toner container at the time T3 on the basis of the total rotation time, which is time obtained by integrating time in which the motor rotates to drive the supply mechanism, in the period of use. Consequently, the toner supply device can accurately estimate a toner residual amount according to the performance of the motor. As a result, it is possible to efficiently use the toner. It is possible to reduce operation costs of the image forming apparatus 500.

A modification of the first embodiment is explained. As a difference from the first embodiment, a difference of processing by the control device 400 is explained. On the other hand, explanation concerning functions common to the first embodiment explained above is omitted.

The motor control unit 414 controls, at the time T1 when the receiving unit 412 receives the instruction signal, the constant current source to apply the driving current necessary for rotating the motor M at the rated number of revolutions Rs to the motor M.

The estimating unit 416 calculates, as a total rotation time, the rotation time Ps integrated in the period of use. That is, the estimating unit 416 integrates, in the period of use, the rotation time Ps not controlled to be the rotation time Pm by the motor control unit 414.

The estimating unit 416 corrects the calculated total rotation time on the basis of the number of revolutions Rm and the rated number of revolutions Rs. More specifically, the estimating unit 416 multiplies the rotation time Ps integrated in the period of use with a value (Rm/Rs) obtained by dividing the number of revolutions Rm by the rated number of revolutions Rs. Consequently, the estimating unit 416 can calculate the total rotation time.

The estimating unit 416 estimates a toner residual amount in the toner container at the time T3 on the basis of the calculated total rotation time.

Figure 6:
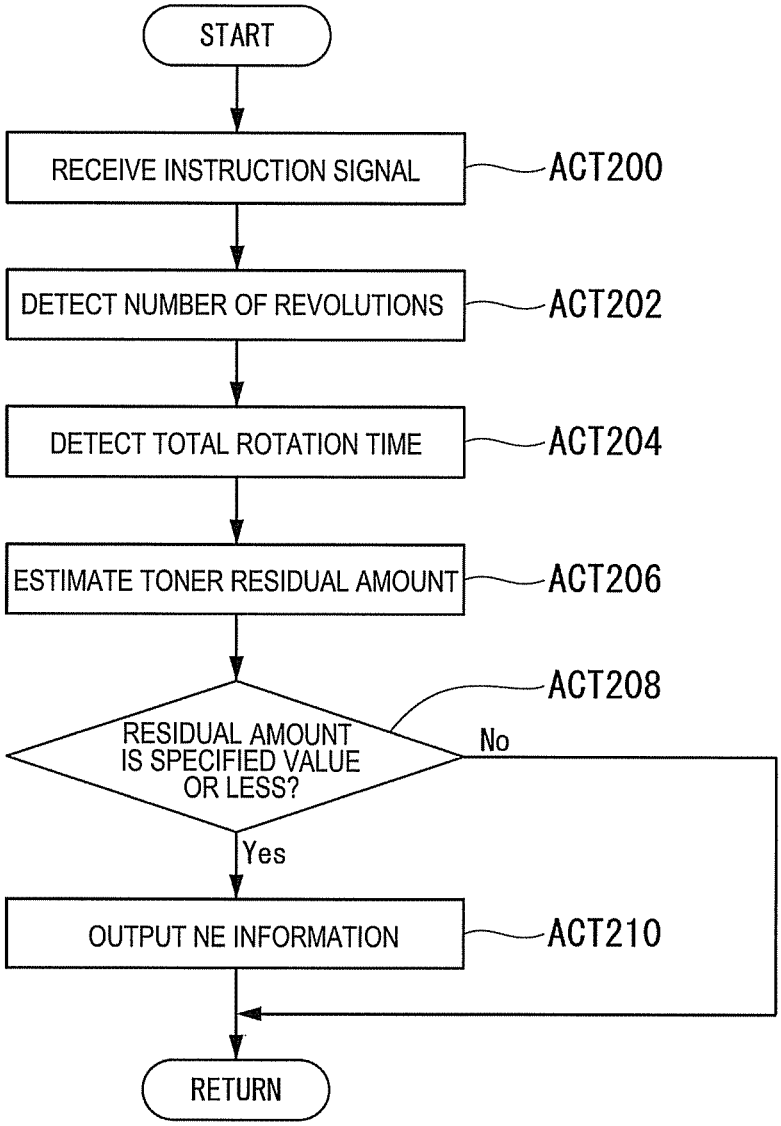
FIG. 6 is a flowchart for explaining an example of a flow of the operation of the toner supply device according to a modification of the first embodiment.

FIG. 6 is a flowchart for explaining an example of a flow of the operation of the toner supply device 10 according to the modification of the first embodiment.

First, the receiving unit 412 receives an instruction signal transmitted from the image forming unit 300 (ACT 200). Subsequently, the control device 400 acquires the number of revolutions Rm of the motor M (ACT 202). Subsequently, the motor control unit 414 controls, at the time T1 when the receiving unit 412 receives the instruction signal, the constant current source to apply the driving current necessary for rotating the motor M at the rated number of revolutions Rs to the motor M.

The estimating unit 416 calculates, as a total rotation time, the rotation time Ps integrated in the period of use (ACT 204). Subsequently, the estimating unit 416 corrects the calculated total rotation time on the basis of the number of revolutions Pm and the rated number of revolutions Rs. The estimating unit 416 estimates a toner residual amount in the toner container at the time T3 on the basis of the calculated total rotation time (ACT 206).

Subsequently, the output unit 418 determines whether the toner residual amount estimated by the estimating unit 416 is the specified value or less (ACT 208). If the toner residual amount is the specified value or less (Yes in ACT 208), the output unit 418 outputs the near-empty information to the display unit of the control panel 200 (ACT 210). If the toner residual amount exceeds the specified value (No in ACT 100), the output unit 418 does not output the near-empty information. The processing of this flowchart ends.

Consequently, it is possible to accurately estimate a toner residual amount according to the performance of the motor while performing simpler control.

A second embodiment is explained below. As a difference from the first embodiment, processing performed by the control device 400 when a user inputs the number of revolutions of the motor M instead of the number of revolutions Rm is explained. On the other hand, explanation concerning functions and the like common to the first embodiment is omitted. In the following explanation, the number of revolutions input by the user is described as "number of revolutions Ri". The number of revolutions Ri is a fixed number of revolutions per unit time.

For example, the user inputs the number of revolutions Ri to the operation unit of the control panel 200 as the number of revolutions for correcting a rotation time. The control panel 200 receives the number of revolutions Ri input by the user.

For example, the number of revolutions Ri is input as a value for equalizing the number of revolutions of the motor M actually in use and the rated number of resolutions Rs set during manufacturing.

The motor control unit 414 controls, at the time T1 when the receiving unit 412 receives the instruction signal, the constant current source to apply the driving current necessary for rotating the motor M at the rated number of revolutions Rs to the motor M. The motor control unit 414 acquires the number of revolutions Ri from the control panel 200.

The motor control unit 414 performs control to correct the predetermined rotation time Ps of the motor M on the basis of the acquired number of revolutions Ri.

For example, the motor control unit 414 corrects the rotation time Ps to equalize the reference toner amount Vs and an estimated toner amount Vi. The estimated toner amount Vi is an amount of the toner supplied when the supply mechanism is driven at the number of revolutions Ri of the motor M input to the operation unit of the control panel 200. In the following explanation, the rotation time Ps corrected on the basis of the number of revolutions Ri is described as "rotation time Pi".

More specifically, as the correction, the motor control unit 414 multiplies the rotation time Ps with a value (Rs/Ri) obtained by dividing the rated number of revolutions Rs by the number of revolutions Ri.

The estimating unit 416 calculates, as a total rotation time, the rotation time Pi integrated in a period of use. The period of use is a period from the time T2 when the motor control unit 414 starts control for applying an electric current to the motor M to the time T3 when the unit 414 stops control.

Subsequently, the estimating unit 416 estimates a toner residual amount in the toner container at the time T3 on the basis of the calculated total rotation time.

If the toner residual amount estimated by the estimating unit 416 is the specified value or less, the output unit 418 outputs the near-empty information to the display unit of the control panel 200.

Figure 7:
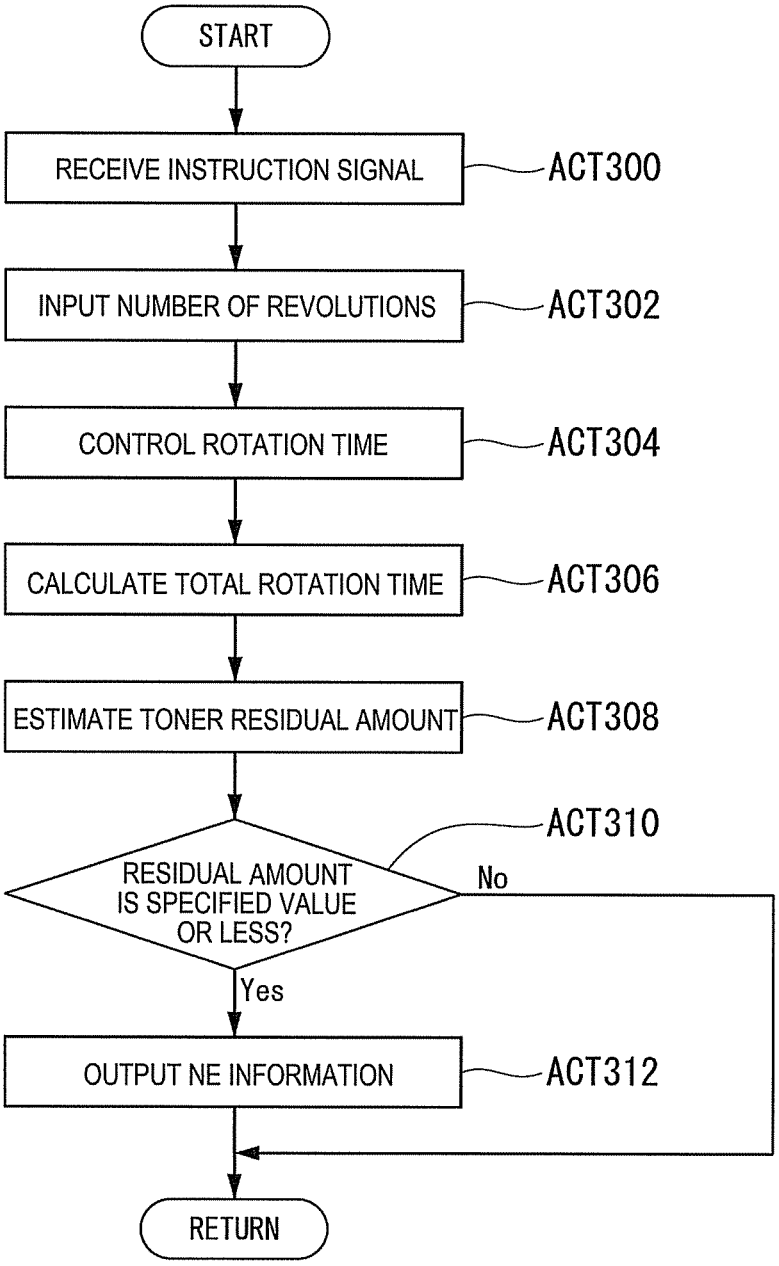
FIG. 7 is a flowchart for explaining an example of a flow of the operation of the toner supply device according to a second embodiment.

FIG. 7 is a flowchart for explaining an example of a flow of the operation of the toner supply device 10 according to the second embodiment.

First, the receiving unit 412 receives an instruction signal transmitted from the image forming unit 300 (ACT 300). Subsequently, the control device 400 acquires the number of revolutions Ri input to the control panel 200 (ACT 302). Subsequently, the motor control unit 414 controls, at the time T1 when the receiving unit 412 receives the instruction signal, the constant current source to apply the driving current necessary for rotating the motor M at the rated number of revolutions Rs to the motor M. The motor control unit 414 performs control to correct the predetermined rotation time Ps of the motor M on the basis of the acquired number of revolutions Ri (ACT 304).

Subsequently, the estimating unit 416 calculates, as a total rotation time, the rotation time Pi integrated in the period of use (ACT 306). The estimating unit 416 estimates, on the basis of the calculated total rotation time, a toner residual amount in the toner container at the time T3 (ACT 308).

Subsequently, the output unit 418 determines whether the toner residual amount estimated by the estimating unit 416 is the specified value or less (ACT 310). If the toner residual amount is the specified value or less (Yes in ACT 310), the output unit 418 outputs the near-empty information to the display unit of the control panel 200 (ACT 312). If the toner residual amount exceeds the specified value (No in ACT 310), the output unit 418 does not output the near-empty information. The processing of this flowchart ends.

Consequently, the toner supply device 10 can calculate the total rotation amount based on the number of revolutions Ri of the motor M input by the user. As a result, it is possible to accurately estimate a toner residual amount according to the performance of the motor.

A modification of the second embodiment is explained below. As a difference from the second embodiment, a difference of processing by the control device 400 is explained. On the other hand, explanation concerning functions and the like common to the second embodiment is omitted.

For example, the user inputs the number of revolutions Ri to the operation unit of the control panel 200 as the number of revolutions for correcting a rotation time. The control panel 200 receives the number of revolutions Ri input by the user.

The motor control unit 414 controls, at the time T1 when the receiving unit 412 receives the instruction signal, the constant current source to apply the driving current necessary for rotating the motor M at the rated number of revolutions Rs to the motor M. The motor control unit 414 acquires the number of revolutions Ri from the control panel 200.

The estimating unit 416 calculates, as a total rotation time, the rotation time Ps integrated in the period of use. That is, the estimating unit 416 integrates, in the period of use, the rotation time Ps not controlled to be the rotation time Pi by the motor control unit 414.

The estimating unit 416 corrects the calculated total rotation time on the basis of the number of revolutions Ri and the rated number of revolutions Rs. More specifically, the estimating unit 416 multiplies the rotation time Ps integrated in the period of use with a value (Ri/Rs) obtained by dividing the number of revolutions Ri by the rated number of revolutions Rs. Consequently, the estimating unit 416 can calculate the total rotation time.

The estimating unit 416 estimates a toner residual amount in the toner container at the time T3 on the basis of the calculated total rotation time.

Figure 8:
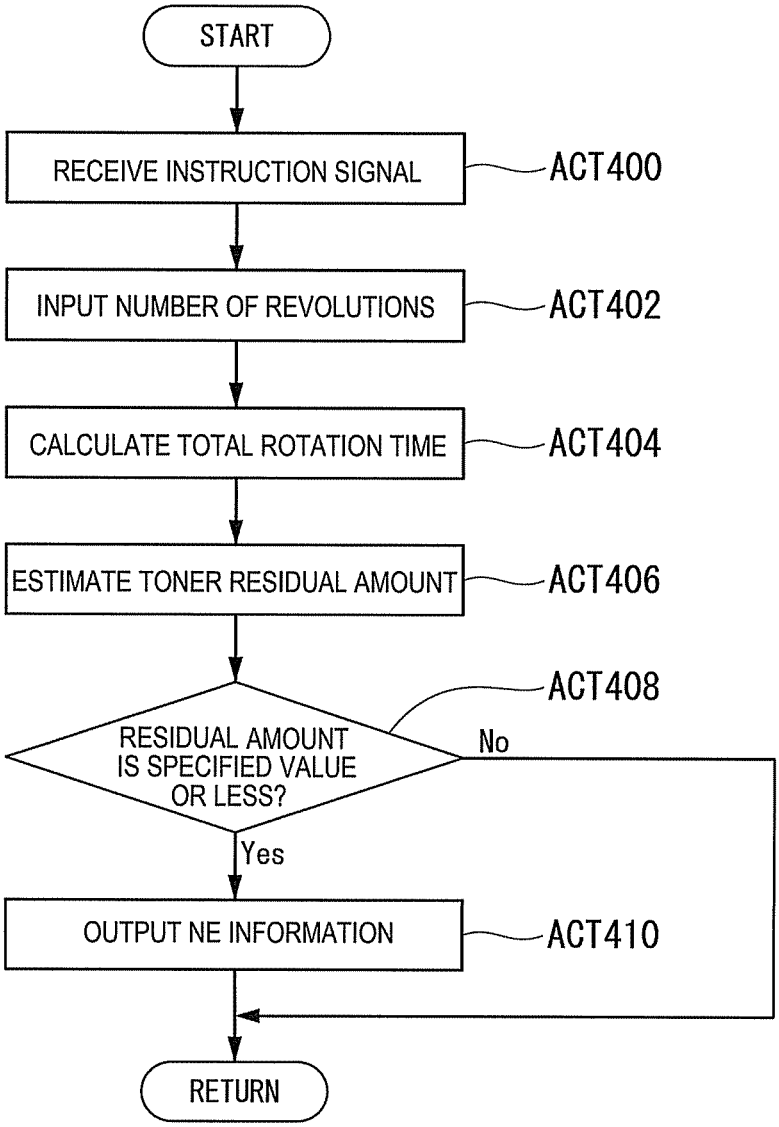
FIG. 8 is a flowchart for explaining an example of a flow of the operation of the toner supply device according to a modification of the second embodiment.

FIG. 8 is a flowchart for explaining an example of a flow of the operation of the toner supply device 10 according to the modification of the second embodiment.

First, the receiving unit 412 receives an instruction signal transmitted from the image forming unit 300 (ACT 400). Subsequently, the control device 400 acquires the number of revolutions Ri input to the control panel 200 (ACT 402) Subsequently, the motor control unit 414 controls, at the time T1 when the receiving unit 412 receives the instruction signal, the constant current source to apply the driving current necessary for rotating the motor M at the rated number of revolutions Rs to the motor M.

The estimating unit 416 calculates, as a total rotation time, the rotation time Ps integrated in the period of use (ACT 404). The estimating unit 416 corrects the calculated total rotation time on the basis of the number of revolutions Ri and the rated number of revolutions Rs. The estimating unit 416 estimates a toner residual amount in the toner container at the time T3 on the basis of the calculated total rotation time (ACT 406).

Subsequently, the output unit 418 determines whether the toner residual amount estimated by the estimating unit 416 is the specified value or less (ACT 408). If the toner residual amount is the specified value or less (Yes in ACT 408), the output unit 418 outputs the near-empty information to the display unit of the control panel 200 (ACT 410). If the toner residual amount exceeds the specified value (No in ACT 408), the output unit 418 does not output the near-empty information. The processing of this flowchart ends.

Consequently, it is possible to accurately estimate a toner residual amount according to the performance of the motor while performing simpler control.

A modification of the embodiments is explained below.

In the embodiments, the motor M is explained as the DC brush motor. However, the motor M may be other motors.

The control device 400 may be a computer separate from the computer that controls the image forming apparatus 500. For example, the control device 400 is a dedicated computer that controls the toner supply device 10.

If a difference between the rated number of revolutions Rs and the number of revolutions Rm exceeds an allowance, the motor control unit 414 may perform control to correct the rotation time Ps of the motor M rotating at the number of revolutions Rm. The allowance is, for example, a value of the difference between the rated number of revolutions Rs and the number of revolutions Rm within 5%. That is, if a value obtained by dividing the rated number of revolutions Rs by the number of revolutions Rm is close to 1, the motor control unit 414 does not correct the rotation time Ps. Consequently, the control device 400 does not need to always perform calculation processing. It is possible to reduce calculation costs.

The output unit 418 may output the toner residual amount estimated by the estimating unit 416 to the display unit of the control panel 200. The output unit 418 may output the near-empty information to other external devices instead of the display unit of the control panel 200.

The toner supply device 10 may include a not-shown measuring unit instead of the sensor S. The measuring unit measures an instantaneous value of an electric current flowing to the motor M. The control device 400 calculates the number of revolutions Rm of the motor M from the electric current measured by the measuring unit. Consequently, even if the number of revolutions of the motor changes according to a toner residual amount (a load) in the toner container, the control device 400 can accurately calculate the number of revolutions from a measured electric current.

According to at least one embodiment explained above, the supply mechanism for supplying the toner in the toner container to the external device is driven. The toner supply device estimates a toner residual amount in the toner container at the time T3 on the basis of a total rotation time, which is time obtained by integrating time in which the motor rotates to drive the supply mechanism, in the period of use. Consequently, the toner supply device can accurately estimate a toner residual amount according to the performance of the motor. As a result, it is possible to efficiently use the toner. It is possible to reduce operation costs of the image forming apparatus 500.

If a plurality of the motors M are manufactured in one process (lot), the user may input the number of revolutions Ri to the operation unit as a value for equalizing the number of revolutions of the motor M actually in use and a lot average value. The lot average value is an average value of the rated number of revolutions Rs calculated for each lot.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A toner supply device comprising:

a motor configured to rotate a toner container that supplies toner to an image forming apparatus;

an estimating unit configured to estimate a toner residual amount in the toner container at a second point in time on the basis of a total rotation time representing time in which the motor rotates in a period of use from a first point in time when the toner container is attached to the image forming apparatus to the second point in time; and a detecting unit configured to detect a number of revolutions per unit time of the motor, wherein the estimating unit corrects the total rotation time on the basis of the number of revolutions per unit time detected by the detecting unit and estimates the toner residual amount on the basis of the corrected total rotation time.

2. The device according to claim 1, wherein the estimating unit calculates a supply amount of the toner in the period of use on the basis of the total rotation time and estimates the toner residual amount in the toner container at the second point in time on the basis of a toner residual amount at the first point in time and the supply amount.

3. The device according to claim 1, wherein the motor is a commutator motor and a number of revolutions of the motor cannot be controlled at a same frequency and a same voltage.

4. The device according to claim 1, further comprising:

a control unit configured to correct and control, to supply the toner in a supply amount equivalent to an amount of the toner supplied when the toner container is rotated at a number of revolutions according to a design rating of the motor to supply a predetermined amount of the toner, a rotation time of the motor in the supply of the toner on the basis of the number of revolutions per unit time detected by the detecting unit.

5. The device according to claim 1, further comprising:

an input receiving unit configured to receive, from a user, an input of a number of revolutions for correcting a rotation time of the motor; and a control unit configured to correct and control, to supply the toner in a supply amount equivalent to an amount of the toner supplied when the toner container is rotated at a number of revolutions according to a design rating of the motor to supply a predetermined amount of the toner, a rotation time of the motor in the supply of the toner on the basis of the number of revolutions received by the input receiving unit.

6. The device according to claim 1, further comprising:

a measuring unit configured to measure an electric current applied to the motor; and a control unit configured to correct and control, to supply the toner in a supply amount equivalent to an amount of the toner supplied when the toner container is rotated at a number of revolutions according to a design rating of the motor to supply a predetermined amount of the toner, a rotation time of the motor in the supply of the toner on the basis of a number of revolutions per unit time estimated from the electric current measured by the measuring unit.

7. The device according to claim 1, further comprising a measuring unit configured to measure an electric current applied to the motor, wherein the estimating unit corrects the total rotation time on the basis of a number of revolutions per unit time estimated from the electric current measured by the measuring unit and estimates the toner residual amount on the basis of the corrected total rotation time.

8. The device according to claim 1, further comprising an output unit configured to output the toner residual amount estimated by the estimating unit.

9. A toner supply device comprising:

a motor configured to rotate a toner container that supplies toner to an image forming apparatus;

an estimating unit configured to estimate a toner residual amount in the toner container at a second point in time on the basis of a total rotation time representing time in which the motor rotates in a period of use from a first point in time when the toner container is attached to the image forming apparatus to the second point in time; and an input receiving unit configured to receive, from a user, an input of a number of revolutions for correcting a rotation time of the motor, wherein the estimating unit corrects the total rotation time on the basis of the number of revolutions received by the input receiving unit and estimates the toner residual amount on the basis of the corrected total rotation time.

* * * * *